US005135828A

United States Patent [19]

Yang et al.

[11] Patent Number: 5,135,828

[45] Date of Patent: Aug. 4, 1992

[54] MULTIACTIVE ELECTROPHOTOGRAPHIC ELEMENT

[75] Inventors: Hsinjin Yang, Fairport; David S. Weiss, Rochester; Scott E. Tunney, Ontario, all of N.Y.

[73] Assignee: Eastman Kodak Company, Rochester, N.Y.

[21] Appl. No.: 748,369

[22] Filed: Aug. 22, 1991

[51] Int. Cl.[5] ..... G03G 5/04

[52] U.S. Cl. ..... 430/59

[58] Field of Search ..... 430/58, 59, 96

[56] References Cited

U.S. PATENT DOCUMENTS

| | | | |
|---|---|---|---|
| 3,041,166 | 6/1962 | Bardeen | 430/58 |
| 3,165,405 | 1/1965 | Hoesterey | 430/87 |
| 3,394,001 | 7/1968 | Makino | 430/67 |
| 3,679,405 | 7/1972 | Makino et al. | 430/57 |
| 3,725,058 | 4/1973 | Hayashi et al. | 430/56 |
| 4,175,960 | 11/1979 | Berwick et al. | 430/58 |
| 4,284,699 | 8/1981 | Berwick et al. | 430/96 |
| 4,578,334 | 3/1986 | Borsenberger et al. | 430/59 |
| 4,666,802 | 5/1987 | Hung et al. | 430/58 |
| 4,701,396 | 10/1987 | Hung et al. | 430/58 |
| 4,719,163 | 1/1988 | Staudenmayer et al. | 430/58 |
| 4,840,860 | 6/1989 | Staudenmayer et al. | 430/59 |
| 4,840,861 | 6/1989 | Staudenmayer et al. | 430/59 |
| 4,971,873 | 11/1990 | Pavlisko et al. | 430/58 |
| 5,085,961 | 2/1992 | Gregory et al. | 430/58 |

*Primary Examiner*—John L. Goodrow
*Attorney, Agent, or Firm*—David F. Janci

[57] ABSTRACT

An improved reusable multiactive electrophotographic element has a charge-transport layer comprising a triarylamine charge-transport material in a binder comprising a polymer containing recurring units having the structure 3 Claims, No Drawings

MULTIACTIVE ELECTROPHOTOGRAPHIC ELEMENT

FIELD OF THE INVENTION

This invention relates to multiactive electrophotographic elements, i.e., elements containing a charge-generation layer and a charge-transport layer. More particularly, the invention relates to such elements which are reusable and contain a triarylamine charge-transport material in the charge-transport layer.

BACKGROUND

In electrophotography an image comprising a pattern of electrostatic potential (also referred to as an electrostatic latent image), is formed on a surface of an electrophotographic element comprising at least an insulative photoconductive layer and an electrically conductive substrate. The electrostatic latent image is usually formed by imagewise radiation-induced discharge of a uniform potential previously formed on the surface. Typically, the electrostatic latent image is then developed into a toner image by bringing an electrographic developer into contact with the latent image. If desired, the latent image can be transferred to another surface before development.

In latent image formation the imagewise discharge is brought about by the radiation-induced creation of electron/hole pairs, which are generated by a material (often referred to as a charge-generation material) in the electrophotographic element in response to exposure to the imagewise actinic radiation. Depending upon the polarity of the initially uniform electrostatic potential and the types of materials included in the electrophotographic element, either the holes or the electrons that have been generated, migrate toward the charged surface of the element in the exposed areas and thereby cause the imagewise discharge of the initial potential. What remains is a non-uniform potential constituting the electrostatic latent image.

Such elements may contain material which facilitates the migration of generated charge toward the oppositely charged surface in imagewise exposed areas in order to cause imagewise discharge. Such material is often referred to as a charge-transport material.

One type of well-known charge-transport material comprises a triarylamine. The term, "triarylamine," as used herein is intended to mean any chemical compound containing at least one nitrogen atom that is bonded by at least three single bonds directly to aromatic rings or ring systems. The aromatic rings or ring systems can be unsubstituted or can be further bonded to any number and any types of substituents. Such triarylamines are well known in the art of electrophotography to be very capable of accepting and transporting charges generated by a charge-generation material.

Among the various known types of electrophotographic elements are those generally referred to as multiactive elements (also sometimes called multilayer or multi-active-layer elements). Multiactive elements are so named, because they contain at least two active layers, at least one of which is capable of generating charge in response to exposure to actinic radiation and is referred to as a charge-generation layer (hereinafter sometimes alternatively referred to as a CGL), and at least one of which is capable of accepting and transporting charges generated by the charge-generation layer and is referred to as a charge-transport layer (hereinafter sometimes alternatively referred to as a CTL). Such elements typically comprise at least an electrically conductive layer, a CGL, and a CTL. Either the CGL or the CTL is in electrical contact with both the electrically conductive layer and the remaining CGL or CTL. The CGL comprises at least a charge-generation material; the CTL comprises at least a charge-transport material; and either or both layers may additionally comprise a film-forming polymeric binder.

Among the known multiactive electrophotographic elements, are those which are particularly designed to be reusable and to be sensitive to imagewise exposing radiation falling within the visible and/or infrared regions of the electromagnetic spectrum. Reusable elements are those that can be practically utilized through a plurality (preferably a large number) of cycles of uniform charging, imagewise exposing, optional development and/or transfer of electrostatic latent image or toner image, and erasure of remaining charge, without unacceptable changes in their performance. Visible and/or infrared radiation-sensitive elements are those that contain a charge-generation material which generates charge in response to exposure to visible and/or infrared radiation. Many such elements are well knwon in the art.

For example, some reusable multiactive electrophotographic elements which are designed to be sensitive to visible radiation are described in U.S. Pat. Nos. 4,578,334 and 4,719,163, and some reusable multiactive electrophotographic elements which are designed to be sensitive to infrared radiation are described in U.S. Pat. Nos. 4,666,802 and 4,701,396.

Many known reusable multiactive electrophotographic elements sensitive to visible or infrared radiation also employ triarylamine charge-transport materials in their CTL. In those elements the triarylamine is dispersed or dissolved in a film-forming polymeric binder that forms the CTL. Such elements are described, for example, in the four U.S. patents noted above. Those patents teach many polymers as having utility as film-forming binders for CTL's. Among the many polymers so described, are polycarbonates, such as poly[2,2-bis(4-hydroxyphenyl)-propane carbonate] (commonly referred to as bisphenol A polycarbonate), polyesters, and vinyl-addition polymers. Elements containing such components fairly adequately perform their intended functions, and, in the case of the elements described in the four U.S. patents noted above, have some very important advantages over other known elements. However, it has been recognized (e.g., in U.S. Pat. Nos. 4,840,860 and 4,840,861) that there are some significant drawbacks associated with such elements.

For example, if the CTL comprises a triarylamine in a bisphenol A polycarbonate film, a significant problem may arise. The problem can occur when the CTL has been adventitiously exposed to ultraviolet radiation (i.e., radiation of a wavelength less than about 400 nanometers, which, for example, forms a signficant portion of the radiation emitted by typical fluorescent room lighting). This can occur, for example, when the electrophotographic element is incorporated in a copier apparatus and is exposed to typical room illumination during maintenance or repair of the copier's internal components. The problem, which has been referred to as a UV-fogging problem, is manifested as a buildup of residual potential within the electrophotographic element over time as the element is exercised through its normal cycles of electrophotographic operation after having been adventitiously exposed to ultraviolet radiation.

For example, in normal cycles of operation such an element might be initially uniformly charged to a potential of about −500 volts, and it might be intended that the element should then discharge, in areas of maximum exposure to normal imagewise actinic visible or infrared exposing radiation, to a potential of about −100 volts, in order to form the intended electrostatic latent image. However, if the electrophotographic element has been adventitiously exposed to ultraviolet radiation, there will be a buildup of residual potential that will not be erased by normal methods of erasing residual charge during normal electrophotographic operation. For example, after about 500 cycles of operation, the unerasable residual potential may be as much as −200 to −300 volts, and the element will no longer be capable of being discharged to the desired −100 volts. This results in a latent image being formed during normal operation, that constitutes an inaccurate record of the image intended to be represented. In effect, the element has become no longer reusable, after only 500 cycles of operation.

While the mechanism of this UV-fogging problem is not presently understood, U.S. Pat. Nos. 4,840,860 and 4,840,861 theorize that the problem may be caused by a chemical change in the triarylamine charge-transport material, induced by absorption of ultraviolet radiation. This is evidenced by an observed color change in the CTL after exposure to ultraviolet radiation. It would be desirable to be able to avoid or minimize this UV-fogging problem.

The present invention satisfies this need.

SUMMARY OF THE INVENTION

It has been unexpectedly found that the UV-fogging problem associated with polycarbonate CTL binder can be avoided if a certain polyimide is employed as the CTL binder instead of polycarbonate.

Thus, the invention provides an electrophotographic element comprising: an electrically conductive support; a charge-generation layer sensitive to visible or infrared radiation; and a charge-transport layer containing a triarylamine charge-transport material. The element additionally contains the improvement wherein the charge-transport layer comprises a polymer containing recurring units having the structure

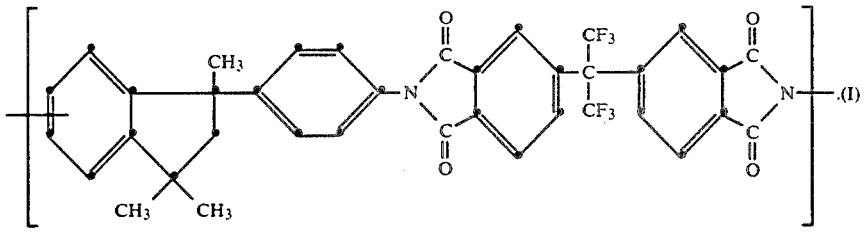

DESCRIPTION OF PREFERRED EMBODIMENTS

As previously defined, the invention pertains to any reusable multiactive electrophotographic element designed to be sensitive to visible and/or infrared radiation and containing any triarylamine charge-transport material in a polymeric CTL. Elements of that type and their preparation and use are well known in the art of electrophotography. For detailed description of such elements and their preparation and use, see, for example, U.S. Pat. Nos. 3,041,166; 3,165,405; 3,394,001; 3,679,405; 3,725,058; 4,175,960; 4,284,699; 4,578,334; 4,666,802; 4,701,396; and 4,719,163, the disclosures of which are hereby incorporated herein by reference. The only essential difference between such well-known elements and elements of the present invention is in the present use of a particular polyimide binder in the CTL.

Although the invention is applicable when any triarylamine serves as a charge-transport material in the CTL, in a particularly preferred embodiment of the invention, the CTL contains the charge-transport material, 1,1-bis[4-(di-4-tolylamino)phenyl]-3-phenylpropane.

Of course, multiactive electrophotographic elements of the invention can contain any of the optional additional layers and components known to be useful in reusable multiactive electrophotographic elements in general, such as, e.g., subbing layers, overcoat layers, barrier layers, screening layers, additional binders, leveling agents, surfactants, plasticizers, sensitizers, and release agents.

Structure (I), illustrated above to describe recurring units contained in the polymer employed in the charge-transport layer of an element in accordance with the invention, is intended to encompass the following alternative isomeric Structures (I-A) and (I-B):

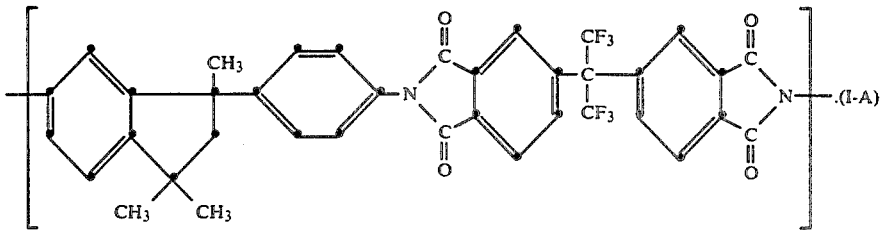

-continued

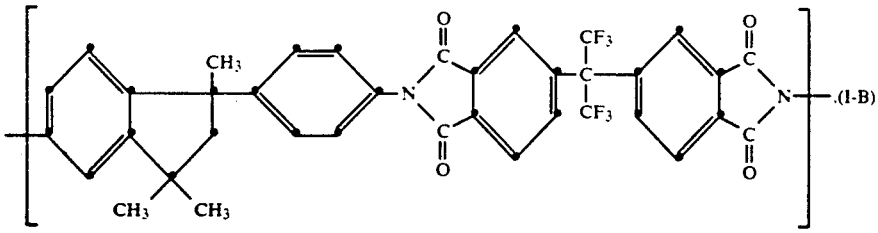

The polymer in the charge-transport layer of an element of the invention can contain recurring units having Structure (I-A), recurring units having Structure (I-B), or recurring units having Structure (I-A) and recurring units having Structure (I-B). All three alternatives serve the purposes of the invention well. In a preferred embodiment of the invention the polymer contains recurring units having Structure (I-A).

The following preparation and example are presented to further illustrate a preferred electrophotographic element of the invention and to compare its properties and performance to those of elements outside the scope of the invention.

A polymer containing recurring units having structure (I-A) was synthesized as described in Preparation 1, below.

PREPARATION 1

Polymer Containing Recurring Units Having Structure (I-A)

A Structure (I-A) polyimide was prepared by addition of an equal molar amount of the dianhydride, 2,2-bis(4-phthalic anhydride)hexafluoroisopropylidene, having the structure

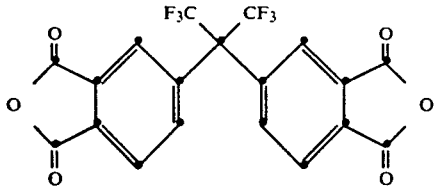

(obtained from the Hoechst Celanese Co., U.S.A.) to a solution of the diamine, 5-amino-3-(4-aminophenyl)-1,1,3-trimethylindan, having the structure

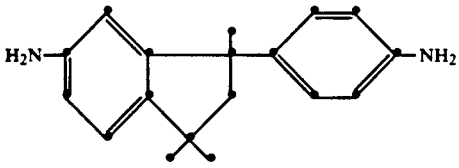

(obtained by transforming the carboxylic acid groups of 5-carboxy-3-(4-carboxyphenyl)-1,1,3-trimethylindan, obtained commercially from the Amoco Corp., U.S.A., to amino groups via the well known Schmidt reaction) in tetrahydrofuran (THF) at room temperature. 8.8849 g (20.000 mmol) of the dianhydride, 5.3278 g (20.000 mmol) of the diamine, and 56 g of THF were employed.

The reaction solution was then stirred at room temperature overnight. To this solution, 3.5 molar equivalents (70 mmol, 5.5 g) of pyridine and 4.0 molar equivalents (80 mmol, 8.2 g) of acetic anhydride were added, and the reaction solution was then again stirred overnight. The solution was precipitated into methanol and the resultant fibrous polymer, having recurring units of Structure (I-A), was chopped in a blender. The polymer was then isolated by vacuum filtration, washed with methanol and dried under vacuum at 100° C. overnight. The inherent viscosity (IV) of the polyimide was determined, in N,N-dimethylacetamide at 0.5 g/dl, 25° C., to be 0.77 dl/g. The yield of Structure (I-A) polyimide was 31.1 g (97%). It was determined to have a number average molecular weight of 27,300, a weight average molecular weight of 188,000 (molecular weights were determined by gel permeation chromatography based on polystyrene equivalents), and a glass transition temperature (determined by differential scanning calorimetry) of 325° C.

EXAMPLE 1

An electrophotographic element of the invention was prepared as follows.

A conductive support was utilized, comprising a 178 micrometer thickness of poly(ethylene terephthalate) film having vacuum-deposited thereon a thin conductive layer of nickel.

An adhesive layer was coated onto the nickel surface of the conductive support from a solution of 4.8 g of poly(acrylonitrile-co-vinylidene chloride) (17:83 molar ratio) in 1.2 kg of methyl ethyl ketone solvent and dried. Coverage after drying was 21.5 mg/m$^2$.

A charge-generation layer was vacuum-deposited onto the adhesive layer by sublimation of the charge-generation material, N,N'-bis(2-phenethyl)-perylene-3,4:9,10-bis(dicarboximide), from a resistance-heated tantalum crucible at a temperature of about 181° C., a pressure of $1.14\times10^{-3}$ Pa, and a crucible to substrate distance of 25 cm, to achieve a coverage of 380 mg/m$^2$.

A charge-transport layer was prepared in darkness by dispersing 0.0095 g of the charge-transport material, 4,4'-bis(diethylamino)tetraphenylmethane, and 1.5 g of the triarylamine charge-transport material, 1,1-bis[4-(di-4-tolylamino)phenyl]-3-phenylpropane, in 30.34 g of the solvent, dichloromethane, and then adding to the solvent: 2.16 g of structure (I-A) polyimide prepared in accordance with Preparation 1, above; and 0.0095 g of a siloxane surfactant sold under the trademark, DC 510, by Dow Corning, U.S.A. The mixture was stirred for 24 hours to dissolve the polymers in the solvent and was then coated onto the charge-generation layer and dried to form the charge-transport layer at a dry coverage of 23.7 g/m$^2$ (a thickness of about 22 micrometers).

The electrophotographic element was then subjected to 50 cycles of operation comprising initially uniformly charging the element to −500 volts, exposing the element through the CTL to visible actinic radiation (radiation having a peak intensity at a wavelength of 640 nm, to which the charge-generation material in the CGL is sensitive in order to generate electron/hole pairs) up to an amount just sufficient to discharge the element to −100 volts (to simulate imaging exposure), and then exposing the element to excess visible radiation in order to attempt to erase the remaining charge. The amount of imaging exposure to visible radiation necessary to reduce the charge from −500 to −100 volts was only 3.7 ergs/cm$^2$ during the initial cycle of operation. After 50 cycles of operation, the electrophotographic element was exposed to typical fluorescent room lighting (having typically significant amounts of ultraviolet output) for 15 minutes at an illuminance of 2152 lux, to simulate adventitious exposure to ultraviolet radiation. The element was then subjected to another 50 cycles of operation, and it was found that the residual potential remaining in the element after attempted erasure by excess radiation (i.e., after the last step of the last cycle) was only −24 volts.

This illustrates that the element exhibited high photosensitivity and little UV-fogging.

Similar results are achieved when the triarylamine charge-transport material in the CTL is tri-p-tolylamine or 1,1-bis[4-(di-p-tolylamino)-phenyl]cyclohexane or when the Structure (I) polymer contains recurring units having Structure (I-B) or contains recurring units having Structure (I-A) and recurring units having Structure (I-B).

For purposes of comparison, control elements outside the scope of the invention were also prepared and tested in order to further illustrate the beneficial effects of the invention. The control elements were prepared and tested exactly as the inventive element described in Example 1, except that the structure (I) polyimide in the CTL was replaced with a different polymer (in the same amount) for each control element.

In a control element referred to as "Control A", bisphenol A polycarbonate (sold under the trademark, Makrolon 5705, by Mobay Chemical Co., U.S.A.) was employed in the CTL instead of the structure (I) polyimide.

In a control element referred to as "Control B", a polyimide comprising recurring units having the structure

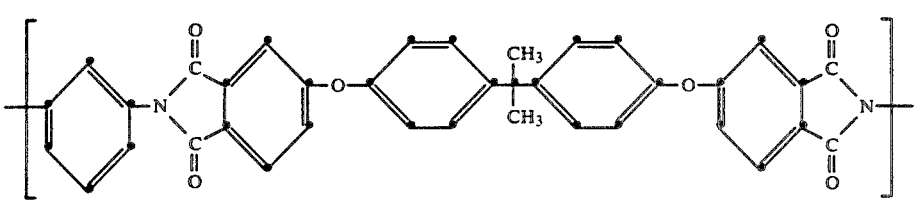

was employed in the CTL instead of the structure (I) polyimide.

In a control element referred to as "Control C", a polyimide comprising recurring units having the structure

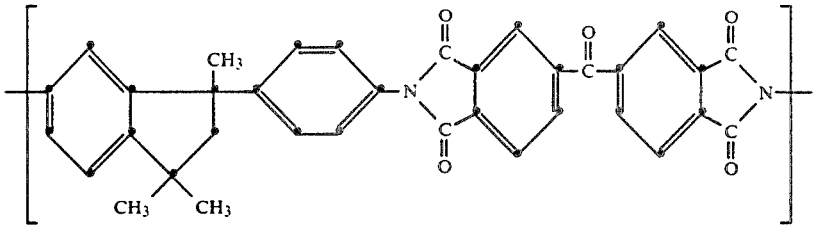

was employed in the CTL instead of the structure (I) polyimide.

Results are presented in Table I.

TABLE I

| Example | residual potential[1] (volts) |
|---|---|
| 1 | −24 |
| Control A | −132 |
| Control B | −490 |
| Control C | −188 |

[1]residual potential, after: 50 cycles of operation, followed by exposure to ultraviolet radiation, followed by 50 more cycles of operation The results in Table I illustrate that in an element of the invention (Example 1) the UV-fogging problem was greatly minimized, so that the element remains reusable after UV exposure (residual potential remains less than −100 volts) in operations involving attempted discharging of the element from −500 volts to −100 volts. This is in contrast to the control elements, which exhibited unacceptable residual potential.

The invention has been described in detail with particular reference to certain preferred embodiments thereof, but it should be appreciated that variations and modifications can be effected within the spirit and scope of the invention.

What is claimed is:

1. In an electrophotographic element comprising:

an electrically conductive support;

a charge-generation layer sensitive to visible or infrared radiation; and a charge-transport layer containing a triarylamine charge-transport material, the improvement wherein the charge-transport layer comprises a polymer containing recurring units having the structure

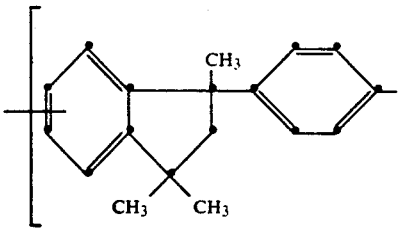
-continued
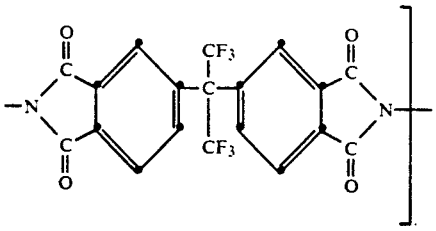
2. The electrophotographic element of claim 1, wherein the triarylamine charge-transport material comprises 1,1-bis[4-(di-4-tolylamino)phenyl]-3-phenylpropane.
3. The electrophotographic element of claim 1, wherein the polymer contains recurring units having the structure
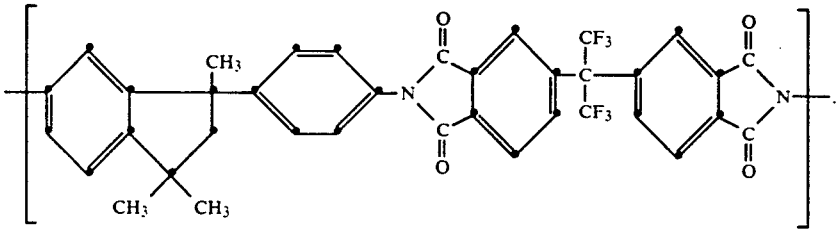
* * * * *